US005286548A

United States Patent [19]

Bolliand et al.

[11] Patent Number: 5,286,548

[45] Date of Patent: Feb. 15, 1994

[54] THERMOBONDING INTERLINING CONTAINING MICROFIBERS

[75] Inventors: Robert Bolliand, Ecully; Pierre Groshens, Doingt Flamicourt, both of France

[73] Assignee: Lainiere de Picardie (S.A.), France

[21] Appl. No.: 725,509

[22] Filed: Jul. 3, 1991

[30] Foreign Application Priority Data

Jul. 12, 1990 [FR] France ..... 90 09255

[51] Int. Cl.[5] ..... B32B 27/14

[52] U.S. Cl. ..... 428/198; 2/272; 428/171; 428/195; 428/288; 428/284; 428/287; 428/296; 428/297; 428/299; 428/340; 428/903

[58] Field of Search ..... 428/195, 198, 284, 287, 428/288, 296, 297, 340, 903, 299, 171; 2/272

[56] References Cited

U.S. PATENT DOCUMENTS 5,034,261 7/1991 Loubnoux et al. ..... 428/195

*Primary Examiner*—James J. Bell

*Attorney, Agent, or Firm*—Ladas & Parry

[57] ABSTRACT

The thermobonding interlining is a nonwoven covered on one face with dots of thermobonding resin. According to the invention, the nonwoven is a web, containing no binding agent, of which the g/m2 weight is less than 50, which is produced from fibers in a thermoplastic material, such as polyamide; the mean diameter of the fibers is comprised between 1 and 5 μm, the consolidation of the nonwoven is obtained by intermingling of the fibers by high pressure streams of fluid, notably by injection of water at pressures of 40 to 80 bars, or by thermal bonding. For example, the fibers being obtained from a mixture of constitutents having different melting points, the bonding points result from the melting and bonding of the zones of fibers having the lowest melting point.

7 Claims, 2 Drawing Sheets

THERMOBONDING INTERLINING CONTAINING MICROFIBERS

FIELD OF THE INVENTION

The present invention relates to the field of interlining, namely to the stiffening of textile articles by fixing a stiffening piece on the underside of said article, and more particularly, the invention relates to an interlining which is thermobonding due to the fact that the stiffening piece called interlining comprises on its surface a resin whose bonding properties are induced by heat, and that said interlining is fixed by being applied to the underside of the textile article under a certain pressure and at a predetermined temperature.

BACKGROUND OF THE INVENTION

Nonwovens are now commonly used as interlining. Cohesion of the nonwovens is obtained either by the addition of binders or by localized thermofusion, applying either on only those fibers known as thermofusible fibers which have the lowest melting point, in the case of a mixture of fibers, or on all the fibers of the nonwoven, in the case of a one-constituent nonwoven.

The characteristics of the final interlining are partly conditional upon these different binding methods.

European Patent No. 0 363 254 describes a thermobonding interlining which consists in a binder-free nonwoven and, since the bonding is not induced by heat, said interlining contains no additional thermofusible fibers. The aim of this patent was to obtain a thermobonding interlining of this type where the thermofusible resin would not come through the material, even in the case of a low g/m2 weight rate. According to said European Patent, said aim was reached with a nonwoven constituted of a web of g/m2 weight comprised between 50 and 150, produced from microfilaments of mean diameter comprised between 3 and 5 μm, the intermingling of which microfilaments is obtained by high pressure streams of fluid.

Therefore, according to the teaching of said patent, the aim could only be reached with a g/m2 weight of 50.

But now, interlining has evolved to such an extent that g/m2 weight smaller than 50 can be used, for example 17 to 25 g/m2 for blouses, 25 to 35 g/m2 for front interlinings in women's clothing.

The problem arising is therefore that of finding a thermobonding interlining having a g/m2 weight less than 50 g/m2 without the risk of the thermofusible resin coming through the material.

SUMMARY OF THE INVENTION

This problem is definitely solved with the fusible interlining according to the invention. Said thermofusible interlining consist, in known manner, in a nonwoven covered on one face with dots of thermo-bonding resin, the nonwoven being a web of fibers containing no binding agent. According to the invention, said web has a g/m2 weight smaller than 50 and is produced from fibers whose mean diameter is comprised between 1 and 5 μm.

It is true that the nonwoven described in European Patent 279 511 has a g/m2 weight comprised between 10 and 40 g, but its fiber count is considerably higher than that of the nonwoven according to the invention, since it is comprised between 0.5 and 8 deniers, bearing in mind that the maximum mean diameter of the fibers according to the invention is 5 um, which is equivalent to a count of about 0.27 denier.

Thus it has been verified, and this is the merit of the invention, that, unlike what is implied in European Patent 0 363 254, the use of microfibers, having a diameter between 1 and 5 μm, enables the production of a nonwoven having a weight less than 50 g/m2 and that such a nonwoven is capable of receiving a thermofusible resin without said resin coming through the nonwoven material, hence being suitable for interlining.

According to a first binding method, the fibers are intermingled by the action of streams of high pressure fluid.

According to another binding method, the web is consolidated by thermofusion, using in particular a point-by-point heating cylinder.

The web may be constituted of only one category of microfibers; in this case, in each point of application of the cylinder, all the fibers which constitute the web are melted and form the bonding points.

Or the web may also be constituted of a mixture of different categories of fibers having different melting points; in this case, the heating cylinder being at an intermediate temperature between the lowest melting point and the highest melting point, only those fibers known as thermofusible fibers, i.e. with the lowest melting point, are melted at each point of application of the cylinder, and form the bonding points by sticking to the other fibers.

And the web may also be constituted of fibers having locally different melting points, obtained by extrusion of a mixture of constituents having different melting points; in this case, the heating cylinder being at a temperature between the lowest melting point and the highest melting point, only the thermofusible zones of the fibers, namely the zones having the lowest melting point, are melted at each point of application of the cylinder and form the bonding points by sticking to the other non-thermofusible zones.

Preferably, the fibers constituting the web contain polyamide. The resulting interlining shows better resilience than with fibers containing for example polyester.

It is another object of the invention to protect a method specially devised for producing an interlining consisting in a web constituted of fibers having locally different melting points, as indicated hereinabove. Said method consists:

a) in mixing in the extrusion hopper, two categories of granules from the same thermoplastic material, the two categories having different melting point;

b) in extruding with an extrusion plate whose holes have a diameter comprised between 200 and 300 μm, and in spraying by means of streams of compressed air at between 0.5 and 5 bars, the thermoplastic material in molten state obtained from said mixture, on an endless conveyor moving at a speed such as to produce a web of weight less than 50 g/m2 without any cohesion of microfibers having locally different melting points, the mean diameter of which filament is between 1 and 5 μm;

c) in causing the web to pass between two cylinders, one at least of which is a point-by-point engraved heating cylinder, brought to a temperature situated between the melting points of said two categories;

d) in placing on the web of fibers thermobonded as indicated, dots of thermofusible resin and in drying said resin.

Preferably, said method is implemented with, as thermoplastic resin, a polyamide 6 consisting of 30 to 35% of a polyamide having a melting point of about 130° C. and 65 to 70% of a polyamide having a melting point of about 220° C., the temperature of the engraved cylinder being between 140° C. and 160° C.

Preferably, the temperature of the heating cylinder or cylinders and the pressure exerted on the web by the cylinders are adjusted so that melting of the thermofusible fibers or zones occurs preferably towards the face of the web in contact with the engraved cylinder and the thermofusible resin is deposited on the other face of the web.

BRIEF DESCRIPTION OF THE DRAWINGS

The invention will be more readily understood on reading the following description of several possible embodiments of a thermobonding interlining of g/m2 weight less than 50, using microfibers of mean diameter ranging between 1 and 5 μm, given with reference to the accompanying drawings, in which.

DESCRIPTION OF PREFERRED EMBODIMENTS

Figure 1:
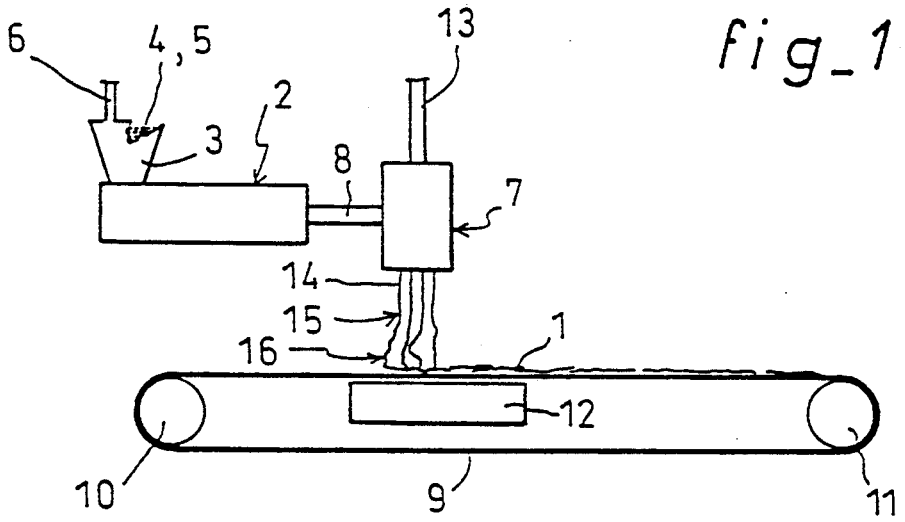
FIG. 1 is a diagrammatical view of the installation for the production of a non-cohesive web of microfibers with locally different melting points.

The installation for producing the web 1 comprises an extruder 2 equipped with a hopper 3. Said hopper 3 is filled with granules 4, 5 of two types of polyamide 6. The polyamide corresponding to the first type of granules 4 has a normal melting point, about 220° C. The polyamide corresponding to the second type of granules 5 has a low melting point, about 130° C. The granules 4, 5 are introduced into the hopper 3 in the form of a homogeneous mixture, comprising 35% of granules 4 of the first type and 65% of granules 5 of the second type.

During extrusion, the hopper 3 is kept under a neutral gas, such as nitrogen for example, which is introduced through an inlet tube 6, in order to prevent the water vapor in the ambient atmosphere, from coming into contact with the molten polyamide.

The polyamide, in the extruder 2, is brought to a temperature of about 250° C., it is mixed and driven towards the extrusion plate 7 via a connecting element 8. A wire mesh filter is placed in the connecting element 8 for retaining any impurities contained in the polyamide granules 4, 5. The extrusion plate 7 comprises holes having a diameter of 300 μm, aligned in one row, at the rate of one to two holes per mm.

Under the extrusion plate 7, a endless conveyor 9 is stretched between two drums 10 and 11, one of which, 11, is driven in rotation by conventional means, not shown. The conveyor 9 is an air-permeable metal screen. A suction box is provided between the two sides of the conveyor 9, immediately below the upper side of said conveyor.

The molten polyamide is forced by the extruder 2 through the holes of the extrusion plate 7 while an air stream, heated to 250° C. is introduced through the channel 13, at a pressure comprised between 0.5 and 5 bars, preferably 3 bars. The hot air stream is directed towards rectangular outlet orifices, provided in the extrusion plate in the immediate vicinity of the extrusion holes. Thus, the polyamide emerging from the extrusion holes is driven at high speed by the stream of hot air; it goes through a considerable extrusion which brings its mean diameter to between 1 and 5 μm. The great force of the air stream causes discontinuities in the flow of the polyamide, so that the resulting discontinuous filaments can be called "microfibers".

An analysis of the obtained fibers shows a distribution comprised between 0.5 and 5 um, with a majority of fibers less than 5 um.

Due to the presence in the hopper 3 of two types of granules 4, 5, one microfiber 15 presents heterogeneities of composition with parts 15 having a melting point of 130° C. and parts 16 having a melting point of 220° C.

The microfibers thus produced are projected on the conveyor 9, and held by the suction exerted by the box 12 on the conveyor 9 in the form of a web 1 which has yet no cohesion. The web has a weight per m2 less than 50 g, depending on the feeding conditions of the extruder 2 and on the speed of the conveyor 9. For a web of 30 g/m2, 90% of the filaments had a diameter comprised between 1 and 5 μm.

Figure 2:
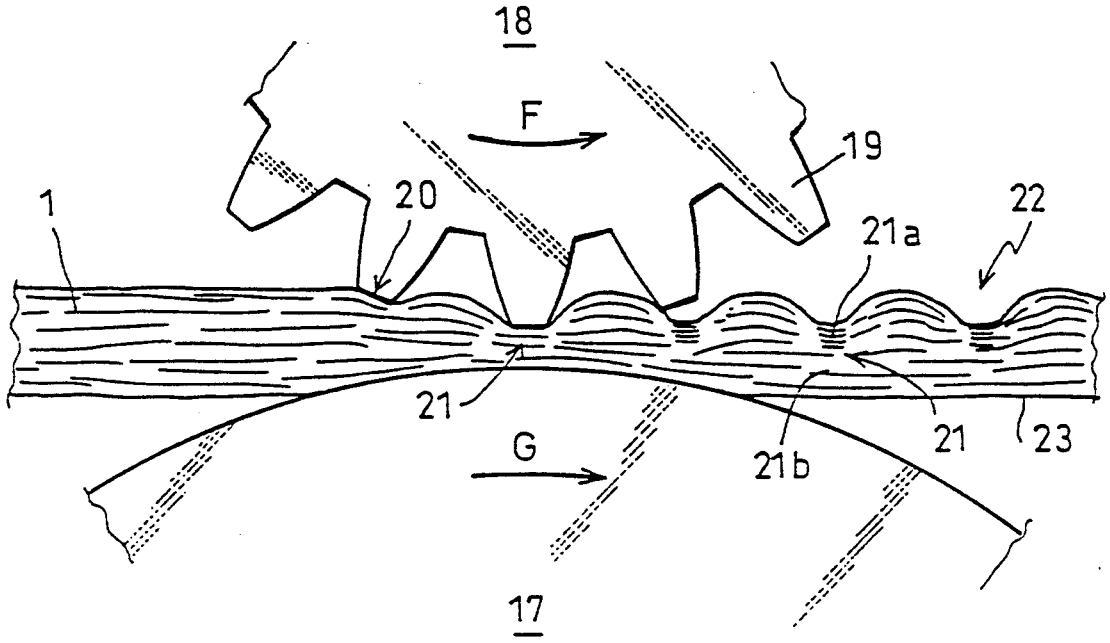
FIG. 2 is a diagrammatical side view of the installation for point-by-point calendering of the web.

The obtained web 1 is driven over the thermobinding installation (FIG. 2). In the case where the two operations are not continuous, the web 1 is wound upon emerging from the conveyor 9; in such a case, a sheet of polyethylene is preferably intercalated during the winding operation in order to prevent subsequent irregular unwinding of the web 1.

The thermobinding installation comprises two cylinders 17, 18 between which passes the web 1. The lower cylinder 17 has a smooth surface. The upper cylinder 18 is engraved according to a relief forming regularly spaced teeth 19. Each tooth 19 has a square-shaped outer surface. The upper cylinder 18 is equipped with a heating device, not shown, for heating the teeth to a temperature comprised between 140° and 160° C.

The web 1 is introduced between the two cylinders 17, 18 moving in rotation according to arrows F and G thus displacing the web 1. During this displacement, the portion 21 of the web, which is in contact with the surface 20 of a tooth 19 of the upper cylinder 18 is progressively compressed between said surface 20 and the smooth surface of the lower cylinder 17. The temperature of the tooth causes the melting of the zones 15 of the microfibers situated in said portion 21, the melting point in said zones being 130° C. The compression of the web, concomittantly with the localized melting of the microfibers, followed by the cooling of the web, causes the bonding of the zones 15 with the other non-molten zones 16 of the microfibers. The portion 21 of web 22, which stayed under a tooth 19, has a first layer **21*a*, facing towards the upper cylinder 18, which constitutes a bonding point of the microfibers, in which all the thermofusible zones 15 have been melted and are bonded to the other zones 16 or to one another. The second layer 21*b*, facing towards the lower cylinder 17, has very few molten zones and has a greater thickness than the layer 21*a*. Cohesion of the web 22 is achieved by bonding points 21*a***.

The consolidated web 22 is then covered on face 23 opposite the lower cylinder 17, with a point-by-point coating of thermobonding resin. Such deposition of dots of resin is achieved by means of engraved cylinders, the resin being deposited either in paste or powder state. Such deposition may also be achieved by means of a printing-type perforated roller in which the paste is fed into the roller and driven out of the roller through the perforations, by means of a scraper. Then, the web 22 on which are deposited the dots of resin, is moved through a drying tunnel.

In the present example, the thermobonding resin is in the form of a polyamide paste; it is deposited with a printing-type perforated roller, of 17 mesh, i.e. having 17 holes in diagonal over a length of 25.4 mm, hence about 44 holes per cm2. Each perforation has a diameter of 0.8 mm.

The thermobonding interlining obtained as indicated above, weighs 30 g/m2, and is perfectly stable under heat. It is suitable for interlining all sorts of clothing articles for which an interlining of low g/m2 weight is sought, particularly for the fronts of women's garments which need to have a good feel and hang. The thermobonding interlining is placed on the underside of the textile material to be stiffened: a strong pressure is applied at a temperature of about 110°–120° C. The thermobonding resin applies to the underside of the textile material without coming through the web. The article interlined with the thermobonding interlining of the invention does not deform with wear.

Figure 3:
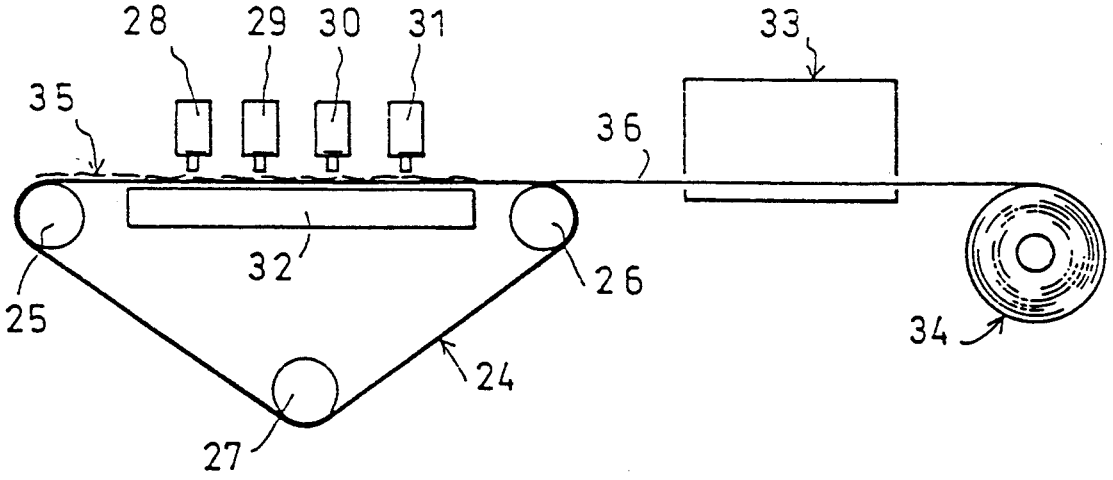
FIG. 3 is a diagrammatical side view of the installation for binding the web by intermingling of the microfibers.

According to another embodiment, using the installation of FIG. 1, the hopper 3 is fed with granules of only one type of polyamide having a normal melting point, i.e. 220° C. The resulting web, composed of fibers with a mean diameter comprised between 1 and 5 μm, is consolidated with the binding installation shown in FIG. 3. Said installation comprises an endless conveyor 24, stretched between two drums; in the present example, there are three drums 25, 26, 27 one of which, 26, is driven in rotation by means not shown. Above the upper side of the conveyor 24 are placed four rows 28 to 31 of water injectors, fed under pressures respectively equal to 40 bars for the first row 28, 60 bars for the second row 29, 70 bars for the third row 30 and 80 bars for the fourth row 31.

The conveyor 24 is a wire screen. The water sprayed thereon by the injectors and bouncing off the wire screen, moves the fibers of the web 35 with respect to one another. The density and diameter of the wires constituting the screen are so selected as to ensure the best intermingling output when the web 35 passes under the rows of injectors 26 to 31. In the present example, the diameter of the wires is 0.5 and the screen has an opening of 30, meaning that the gap between the meshes of the screen represents 30% of the total surface.

The water is collected in suction boxes provided under the conveyor 24, vertically to the rows of injectors 28 to 31, said water being recycled via a set of pumps, not shown.

The consolidated web 36 enters a drying tunnel 33, after which it is wound up to form a reel 34.

The nonwoven obtained is smooth, very cohesive and not plushy. In the illustrated example, it had a weight of 30 g/m2.

The thermobonding resin coating was performed in the same conditions as indicated above.

The invention is not limited to the embodiments described by way of example and non-restrictively. It also covers all variants. For example, the web being composed of only one thermoplastic material, a bonding point results from the melting of all the portion of microfibers situated between the tooth of the heating cylinder and the other cylinder. In this case, the bonding points are very rigid. For example, the web may be composed of a mixture of microfibers, having different melting points.

Moreover, the thermofusion causing the thermal binding of the web can be obtained by other means than heating cylinders. In particular, it is possible to use the localized action of ultra-sounds for causing the temperature rise capable of melting some of the fibers constituting the web; to this effect, a vibrating anvil can for example be used, said anvil generating ultra-sounds which are applied to the web when said web passes over an engraved cylinder.

What is claimed is:

1. Thermobonding interlining consisting in a nonwoven covered on one face with dots of thermobonding resin, said nonwoven being a web of fibers containing no binding agents, wherein said web has a g/m2 weight less than 50 and is produced from fibers having a mean diameter comprised between 1 and 5 μm.

2. Thermobonding interlining as claimed in claim 1, wherein the fibers are intermingled by the action of streams of high pressure fluid.

3. Thermobonding interlining as claimed in claim 1, wherein the web comprises bonding points obtained by thermofusion of the fibers.

4. Thermobonding interlining as claimed in claim 3, wherein, since the fibers constituting the web only have one constituent, the bonding points are formed by the localized melting of all the fibers.

5. Thermobonding interlining as claimed in claim 3, wherein, since the web is constituted of a mixture of categories of fibers having different melting points, the bonding points are formed by the melting of those fibers having the lowest melting point and by their bonding to the other fibers or to one another.

6. Thermobonding interlining as claimed in claim 3, wherein, since the web is constituted of fibers having locally different melting points, the bonding points are formed by the melting of the zones of fibers having the lowest melting point and by their bonding to the other zones of fibers or to one another.

7. Thermobonding interlining as claimed in claim 1, wherein the web is constituted of polyamide fibers.

* * * * *